US005605326A

United States Patent [19]

Spear, Jr.

[11] Patent Number: 5,605,326

[45] Date of Patent: Feb. 25, 1997

[54] OBJECT HITTING APPARATUS

[75] Inventor: Thomas C. Spear, Jr., Longwood, Fla.

[73] Assignee: Sport Innovations, Inc., Longwood, Fla.

[21] Appl. No.: 342,372

[22] Filed: Nov. 18, 1994

[51] Int. Cl.[6] ..... A63B 69/40

[52] U.S. Cl. ..... 273/26 R

[58] Field of Search ..... 273/26 R, 26 E, 273/29 A, 197 R, 197 A

[56] References Cited

U.S. PATENT DOCUMENTS

| | | | |
|---|---|---|---|
| 1,862,044 | 7/1932 | White . | |
| 1,976,405 | 10/1934 | Witt | 273/197 R |
| 2,017,720 | 10/1935 | Lake | 273/26 |
| 2,633,320 | 3/1953 | Salmi | 273/26 E |
| 3,271,030 | 9/1966 | Mueller | 273/26 |
| 3,341,200 | 9/1967 | Brandley | 273/26 |
| 3,408,070 | 10/1968 | Gonzalez | 273/26 E |
| 3,601,398 | 8/1971 | Brochman | 273/26 E |
| 4,830,371 | 5/1989 | Lay | 273/26 E |

*Primary Examiner*—Theatrice Brown
*Attorney, Agent, or Firm*—Edward M. Livingston, Esq.

[57] ABSTRACT

An object hitting apparatus has an object, such as a ball (7), attachable to a swivel arm (1, 33) which may actuate an impact-measurement device (11, 14) when the object is struck with a bat, a racket, one's foot, hand or other hitting device. On a ball-joint embodiment, the swivel arm (1) is rotated and oriented universally on a ball-joint hub (6) to assimilate flight direction for analyzing trajectory and distance of flight of an unattached baseball, tennis ball, golf ball, puck or other object so hit. On a hinged-arm embodiment, flight angle is indicated by a hinged swivel arm (33). The object can be returned to a position for hitting at an adjustably desired height. Optional electronic means are provided for readout of impact force, flight trajectory and distance of travel of an actual object hit the same as the attached object.

5 Claims, 5 Drawing Sheets

FIG. 9
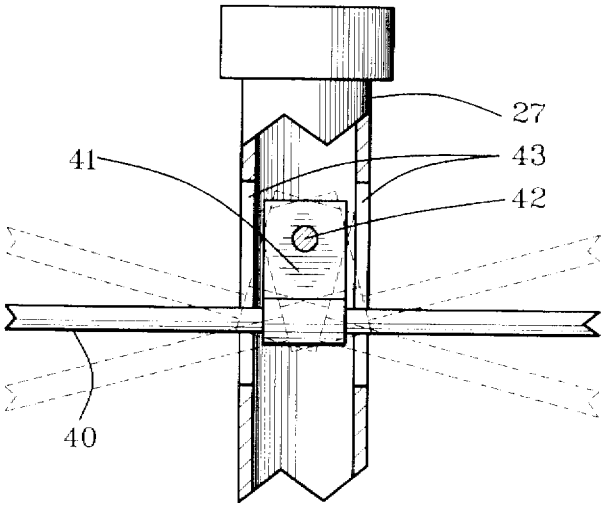
FIG. 10
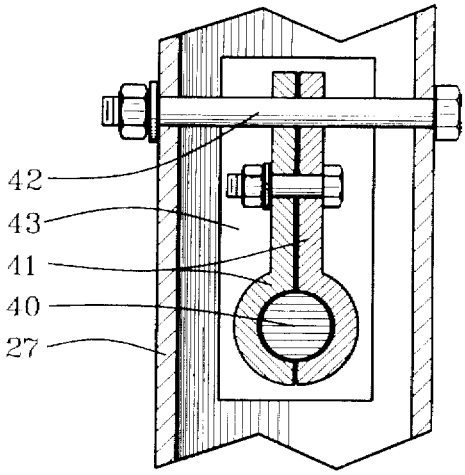
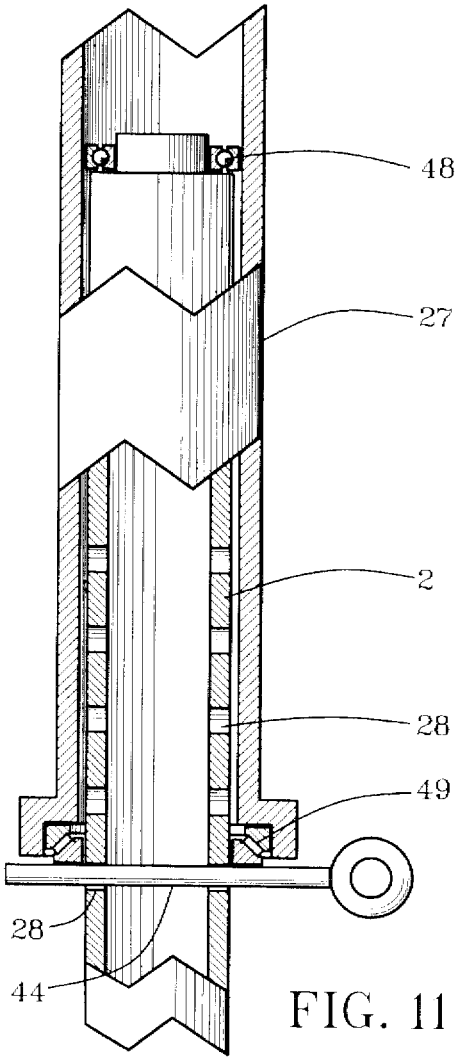
FIG. 11
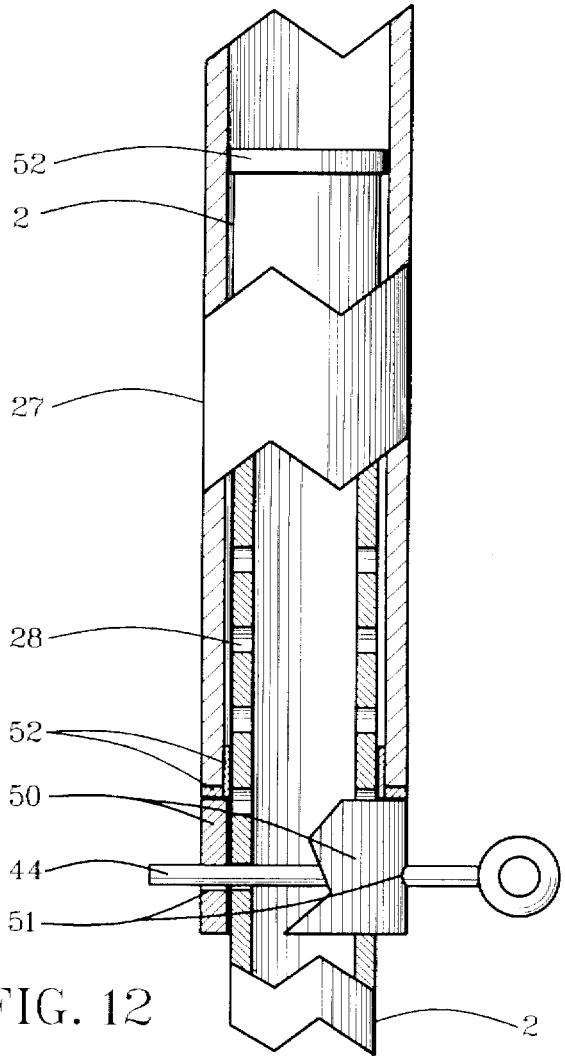
FIG. 12

OBJECT HITTING APPARATUS

BACKGROUND OF THE INVENTION

This invention relates to athletic equipment for training exercise in hitting objects, such as baseballs, tennis balls and other balls, or objects such as hockey pucks. In particular, it is a swivel-arm holder which positions a facsimile of a ball or other object where desired for hitting practice repeatedly and which may calculate impact force of hitting, direction of travel and distance of travel of an actual ball.

A wide variety of hitting-practice mechanisms are known. The most commonly-used hitting-practice device is the standard batting "T", which consists of one upright pole on which a ball is placed and then hit. However, the device does not retain the ball which must be chased after each hit.

One of the more recent patented batting-practice mechanisms is described in U.S. Pat. No. 4,830,371, issued May 16, 1989, by Lay. The Lay device is a spring-based tee that positions a baseball or softball at a desired height relative to a trainee's waist. A coil spring at a base of the tee repositions a ball on a top of the tee conveniently and quickly after the ball has been struck. This allows a trainee to hit the ball repeatedly to gain hitting exercise from hitting a still ball. But it does not measure impact strength or flight direction as taught by this invention.

A swivel-arm device is described in U.S. Pat. No. 2,633,320, issued Mar. 31, 1953, by Salmi. It teaches a ball on a swivel arm which rotates a quarter of a turn but does not provide variable ball positioning, hitting-trajectory indication, impact-force analysis and other features taught by this invention. Other devices different from this invention but with a ball attachable to a pivot arm are described in U.S. Pat. No. 3,408,070, issued Oct. 29, 1968, by Gonzales, et al.; U.S. Pat. No. 3,271,030 issued Sep. 6, 1966, by Mueller; and U.S. Pat. No. 1,862,044, issued Jun. 7, 1932, by White.

As none of the above devices is adequate, even today professional ball players still practice ball-hitting by standing in front of a wall and hitting the ball against it. Furthermore, there still has been no hitting-practice device that duplicates and analyzes hitting conditions thoroughly enough for either beginner or professional levels of training.

SUMMARY OF THE INVENTION

In light of problems that have existed and that continue to exist in this field, objectives of this invention are to provide an object hitting apparatus primarily for practice which:

Positions an object adjustably at a desired height for hitting;

Measures impact force of hitting the object;

Indicates direction of travel of the object after being hit;

Calculates assimilated trajectory and distance of travel of an actual unattached object; and Returns the object quickly and conveniently to a predetermined position for practice hitting.

This invention accomplishes the above and other objectives with an object hitting apparatus having a baseball, tennis ball, golf ball, other ball or facsimile thereof attached to a swivel arm which actuates an impact-measurement device when the object or facsimile thereof is struck with a bat or other hitting device. For a ball-joint embodiment, the swivel arm is rotated and oriented universally on a ball joint to assimilate flight attitude for analyzing hitting trajectory and distance of flight of an unattached object so hit. For a hinged-arm embodiment, a hinged swivel arm is employed to indicate verticality of flight direction. The object can be returned to a position for hitting at an adjustably desired height. Electronic means are optional for readout of trajectory and speed of assimilated pitching and practice hitting of the object.

BRIEF DESCRIPTION OF THE DRAWINGS

This invention is described by appended claims in relation to a description of a preferred embodiment with reference to the following drawings which are described briefly as follows:

FIG. 9 is a sectional cutaway front view of an arm-pivot section of the FIG. 5 embodiment;

FIG. 10 is a sectional cutaway side view of the FIG. 9 illustration;

FIG. 11 is a sectional cutaway elevation view of an optional single friction-reduction top bearing and an optional single friction-reduction bottom bearing;

FIG. 12 is a sectional cutaway elevation view of an optional friction top bearing and an optional friction bottom bearing.

DESCRIPTION OF PREFERRED EMBODIMENT

Figure 1:
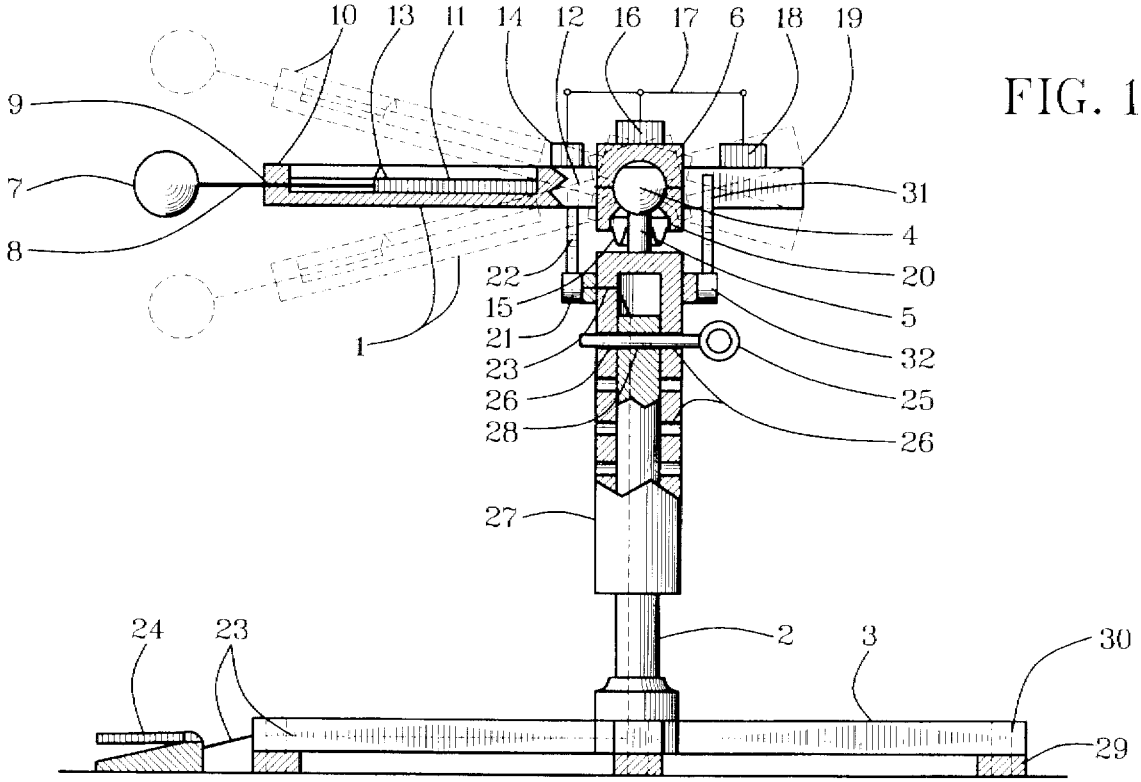
FIG. 1 is a partial cutaway side elevation view of a ball-joint embodiment of this invention.

Reference is made first to FIG. 1. A swivel arm 1 is attached pivotally at a hub end to a swivel-arm pillar 2. The swivel-arm pillar 2 is a rod or a tube that extends upright vertically from a pillar base 3. Pivotal attachment of the swivel arm 1 to the swivel-arm pillar 2 can be provided with a ball-joint connection having an axle ball 4 on an axle shaft 5. A split ball socket can pivot universally within physical limitations of a hub 6 in which the ball-joint connection is positioned.

An object, such as a ball 7, or a facsimile thereof, is attached to a tether 8 which is inserted into a tether entrance 9 in a ball-attachment end 10 of the swivel arm 1. A resilient means 11 is extended intermediate the ball-attachment end 10 and a hub end 12 of the swivel arm 1. When the ball 7 is hit by a trainee for practice, the tether 8 pulls the resilient means 11 which measures impact force of a hit of the ball by an extent to which the resilient means 11 is stretched. In addition to being an impact meter, the resilient means 11 also returns the ball 7 to the ball-attachment end 10 of the swivel arm 1 to be hit again for practice hitting.

A mechanical readout 13 can be provided to indicate how far the resilient means was pulled along or within the swivel arm 1. An electronic impact readout 14 is positioned on the pivot arm 1 to record and to calculate impact force additionally as desired.

A cross section of the swivel arm can be cylindrical or rectangular and hollow or solid, provided it has internal passageway, such as a channel or a tube, for the tether 8 and means for containing the tether 8 and the resilient means 11.

A resilient leveling means 15 is provided to maintain horizontal attitude of the swivel arm 1 until a ball 7 on the tether 8 is hit and causes the swivel arm 1 to tilt upward if the ball 7 is hit upward and to tilt downward if the ball 7 is hit downward. A flight-angle-measuring device 16 is provided on the swivel arm 1 to determine flight angle from tilt of the swivel arm. The flight-angle-measuring device 16 can be float-operated and can have electronic readout means.

Flight angle and impact force can be used to calculate flight trajectory and flight distance of an untethered ball. With electronic operation of the flight-angle-measuring device 16 and the electronic impact readout 14, a trajectory indicator and distance indicator is joined electrically with electrical lines 17 as shown and combined as a performance indicator 18 to indicate performance effects of each practice hit of the ball 7.

The performance indicator 18 with its supportive flight-angle-measurement device 16 with electronic operation and the electronic impact readout 14 are for more sophisticated construction of this invention with higher cost. Some users will prefer a simpler and less expensive model with only mechanical readout means that only indicate impact force and angle of flight of the ball 7.

A counterbalance weight 19 is positioned opposite the hub 6 from the swivel arm 1 to help maintain horizontal attitude of the swivel arm 1. This reduces work load of the resilient leveling means 15 and decreases its resistance to vertical travel of the swivel arm 1 that results from flight angle of the ball 7 when hit by a practicing athlete. The resilient leveling means 15 can be any of a variety of spring means. An illustrated example is a "V" spring, which is a form of Bellville spring or a series of Bellville springs positioned circumferentially intermediate the axle shaft 5 and a hub skirt 20.

The swivel arm 1 can be made to travel circumferentially to provide movement of the ball 7 for assimilating a pitched ball for batting practice. An arcuate travel of the ball 7 will be similar to a curved pitch. This is achieved by a trip spring 21 that actuates a spring arm 22 when released by a trip cord 23. The trip cord 23 is operated by a foot release 24 or other release means that can be positioned for release by the practicing trainee, by a timing device or other means. The trip spring 21 can be similar to a clock spring or such other spring means as desired for particular design objectives.

Height of the swivel arm 1 can be varied and maintained where set by a lock pin 25 being inserted into sleeve orifices 26 of a swivel-arm sleeve 27 when the sleeve orifices 26 are in line concentrically with a pillar-height orifice 28 in the swivel-arm pillar 2. The axle shaft 5 is extended from a top of the swivel-arm sleeve 27 and the swivel-arm sleeve 27 is positioned on the swivel-arm pillar 2 as illustrated to provide for height adjustment with the lock pin 25. The lock pin 25 also prevents rotation of the axle shaft 5 and axle ball 4.

Figure 2:
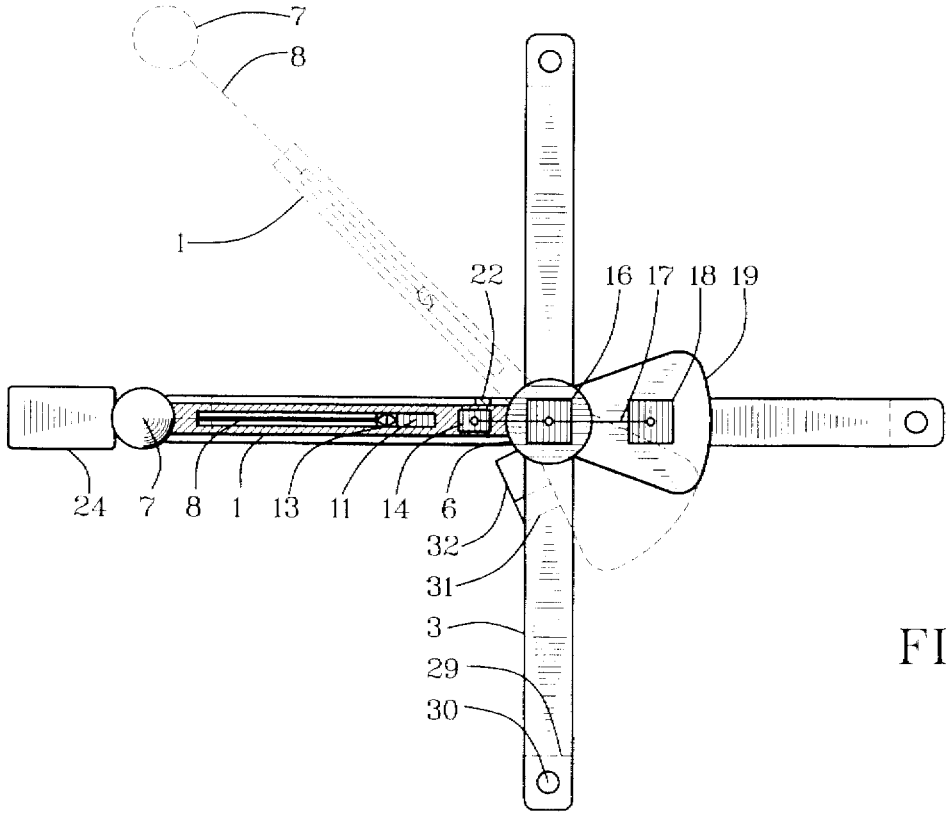
FIG. 2 is a top view of the FIG. 1 illustration.

Referring to FIGS. 1–2, the pillar base 3 can be provided with base feet 29 for some use conditions. Cushioned base feet 29 are particularly suitable for indoor use. For outdoor use with or without the base feet 29, ground-stake apertures 30 is provided for staking the pillar base 3 to a ground surface where desired.

Rotational travel of the swivel arm 1 can be stopped with a rotational stop 31 extended vertically from the swivel-arm sleeve 27. As for the spring arm 22, the rotational stop 31 can be provided with a stop spring 32 that can be a spiral type like a clock spring or such other type as selected for design objectives. Typically, the rotational stop 31 can be extended from the swivel-arm sleeve 27 at an angle that allows approximately 45 degrees of travel of the swivel arm 1 as illustrated. Verticality of travel of the swivel arm 1 should be designed for an included angle of 40 to 60 degrees with the size and shape of the hub skirt 20.

A representation of home plate would be positioned vertically below the ball 7. A home-plate icon may be different for inside than for outside use.

Figure 3:
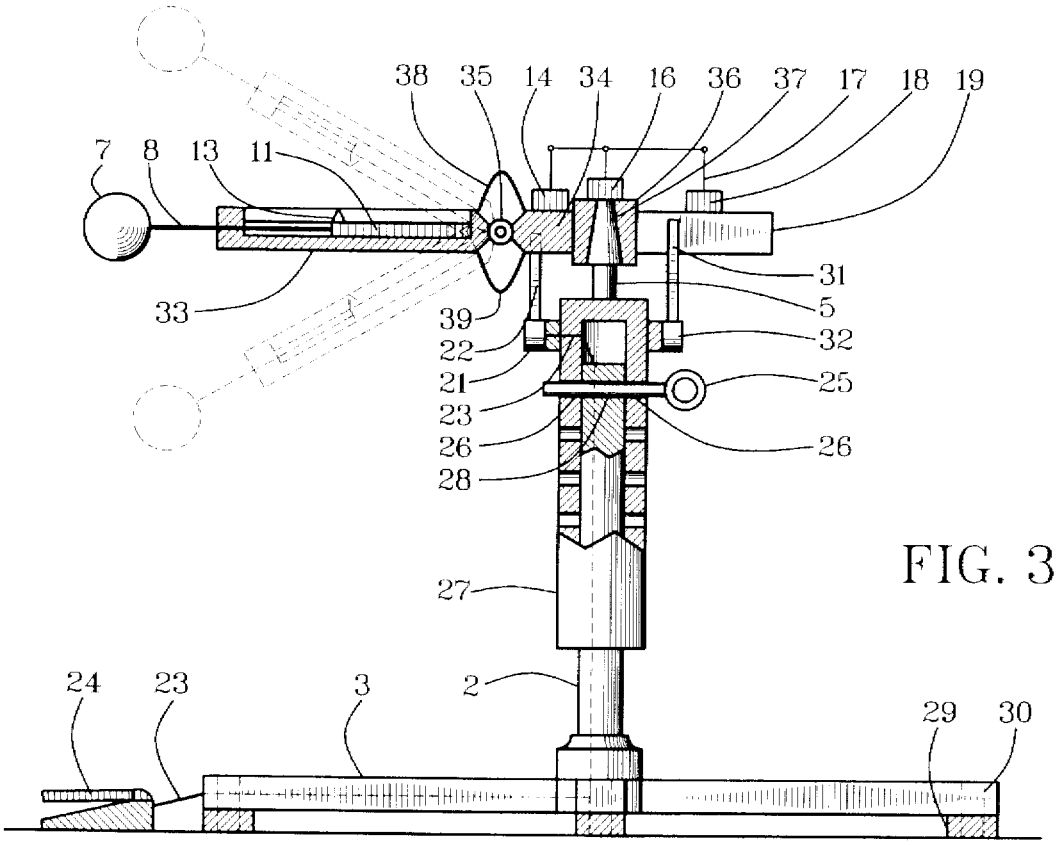
FIG. 3 is a partial cutaway side elevation view of a hinged-arm embodiment.
Figure 4:
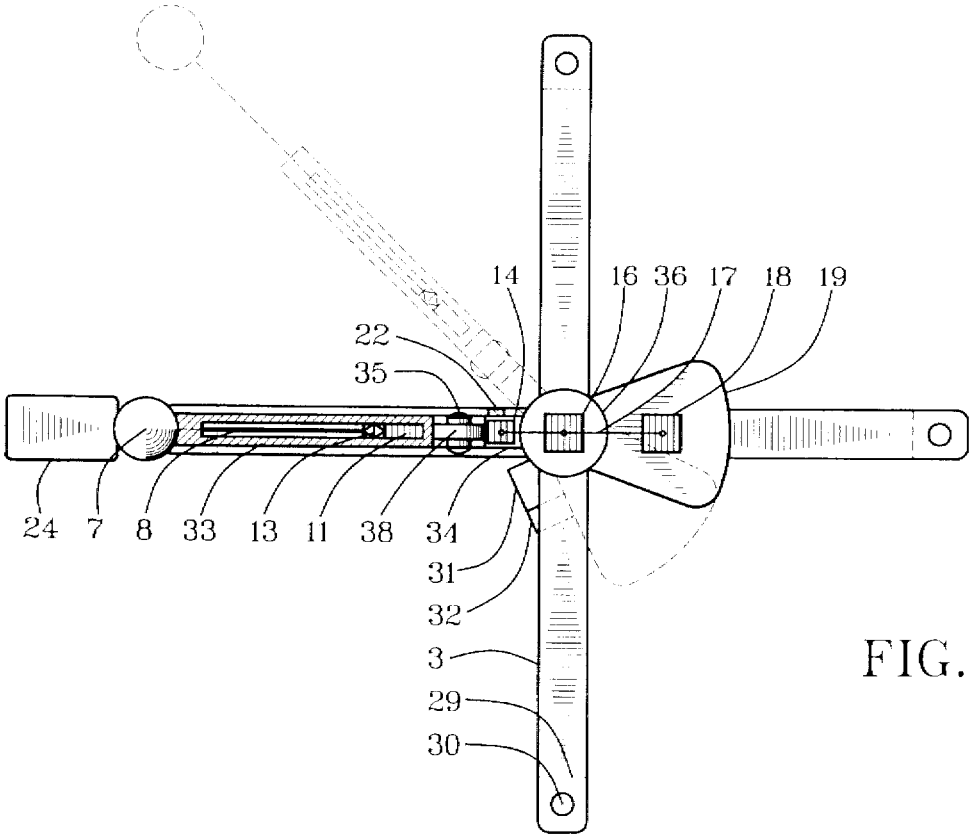
FIG. 4 is a top view of the FIG. 3 illustration.
Figure 5:
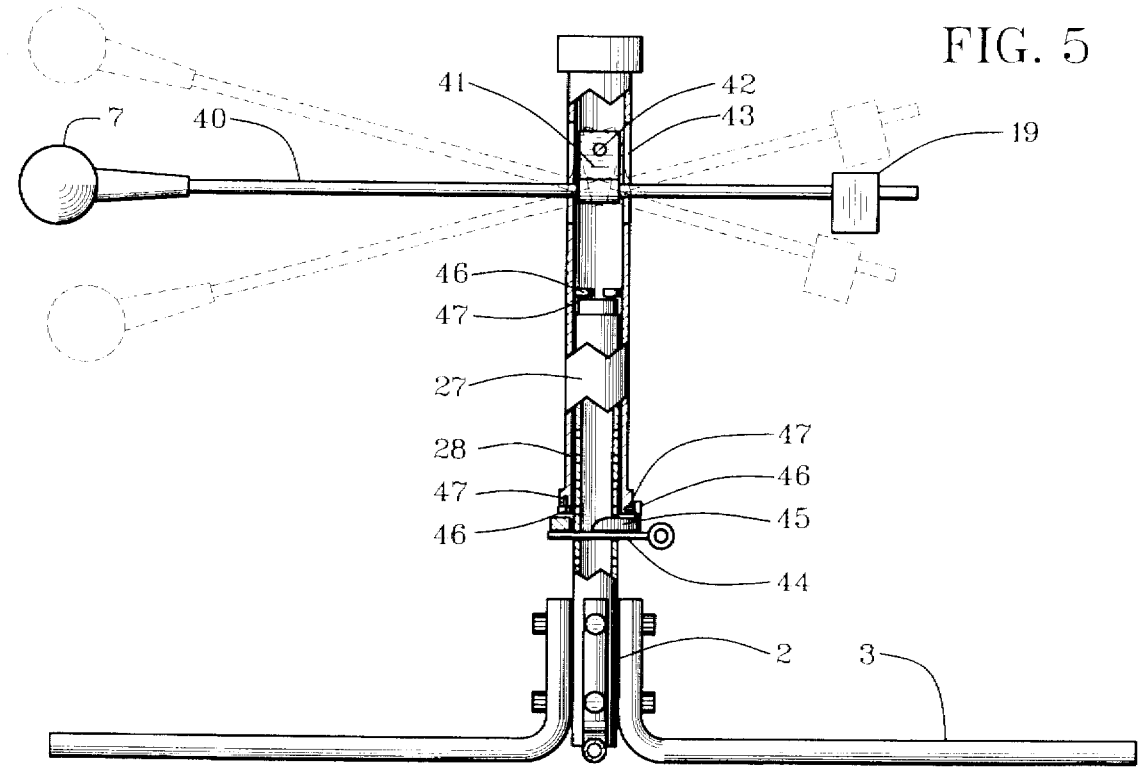
FIG. 5 is a cutaway side view of an embodiment having a swivel-arm sleeve rotatable on a swivel-arm pillar.
Figure 6:
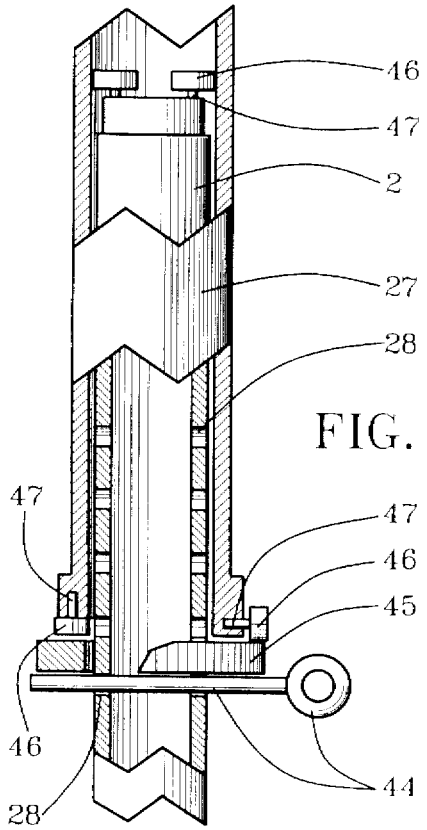
FIG. 6 is a cutaway sectional view of a friction-reduction means having multiple friction-reduction bearings.
Figure 7:
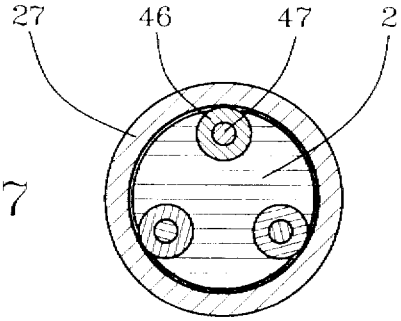
FIG. 7 is a sectional top view of top roller bearings shown in FIG. 6.
Figure 8:
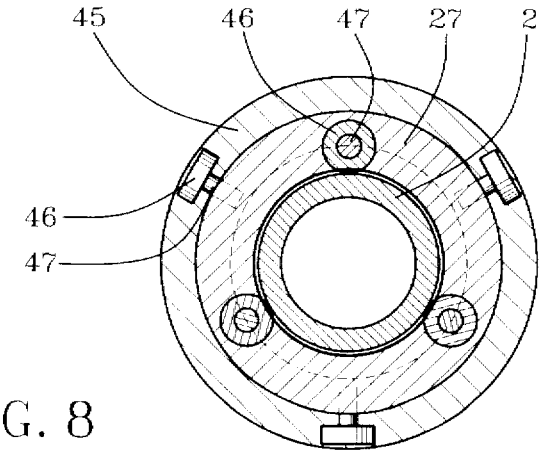
FIG. 8 is a sectional plan view of bottom bearings shown in FIG. 6.
Figure 13:
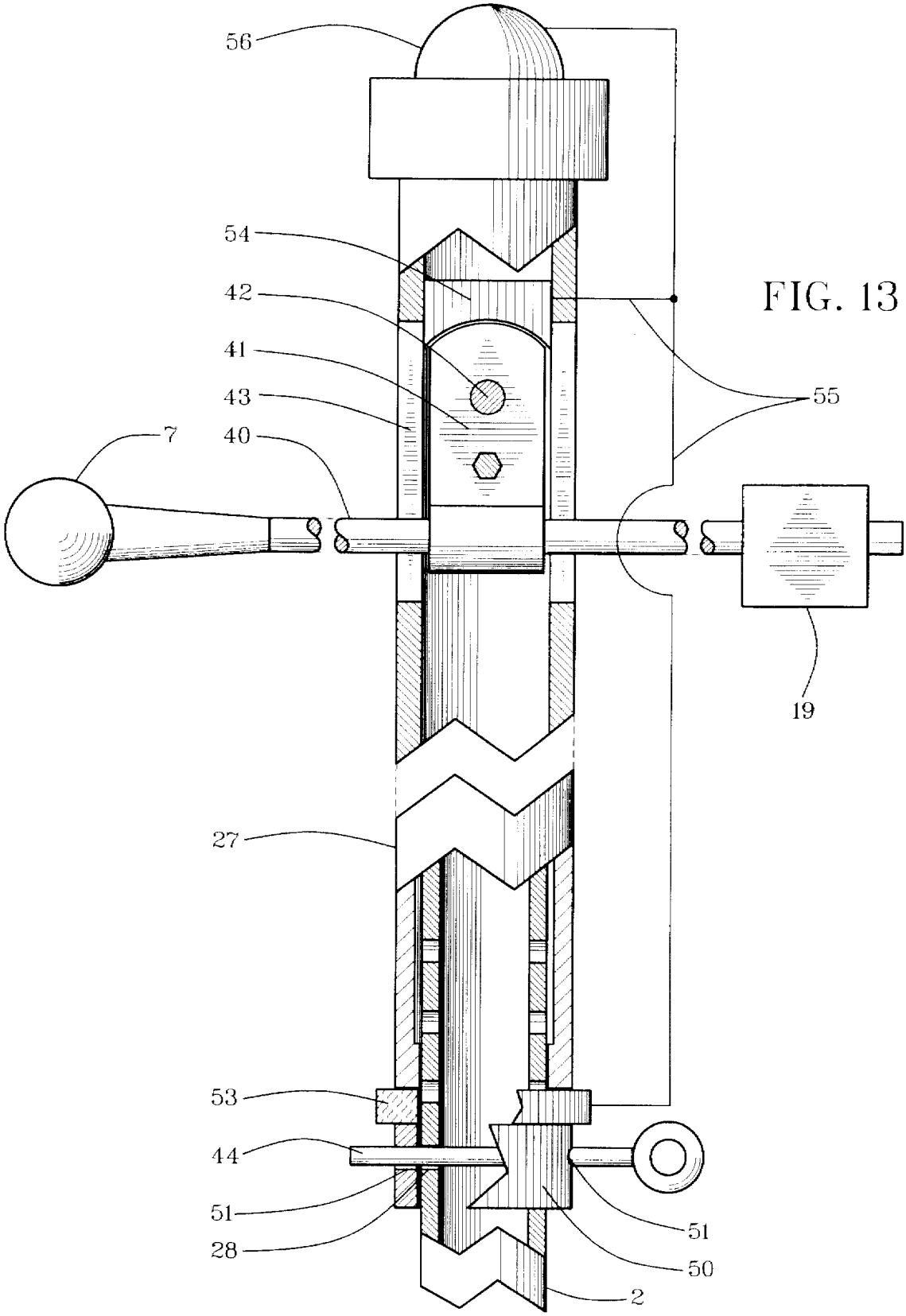
FIG. 13 is a sectional cutaway elevation view of an optional means for indicating hitting force and trajectory.

Reference is made now to FIGS. 3–4. A hinged swivel arm 33 is hinged to hub base 34 with a hinge 35 for an optional embodiment. A horizontal-pivot hub 36 pivots horizontally on a shaft axle 37. The hub base 34 is attached rigidly to the horizontal-pivot hub 36. Vertical travel of the hinged swivel arm 33 arcuately is resisted by top hinge spring 38 and bottom hinge spring 39 that can be "V" springs or other types of springs. A coil spring in a torsional "mouse-trap" arrangement is a design alternative to the "V" springs illustrated.

Other aspects of this embodiment shown in FIGS. 3–4 are the same as described in relation to FIGS. 1–2. This embodiment can be provided for those who desire greater variation of vertical travel, greater control of rotational travel and other features.

Reference is made now to FIGS. 5–10. In one embodiment of this invention, the swivel-arm sleeve 27 is rotatable on the swivel-arm pillar 2. A swivel rod 40 is attached to a suspension bracket 41 that is pivotal on a suspension axle 42. The suspension axle 42 is positioned above the swivel rod 40 and inside of the swivel-arm pillar 2. Rod openings 43 in walls of the swivel-arm pillar 2 are provided to allow pivotal motion of the swivel rod 40 and the suspension bracket 41.

The ball 7 or facsimile thereof is attached to a ball-attachment end of the swivel rod 40. The counterbalance weight 19 is sized and shaped to be positioned on a desired portion of the swivel rod 40 for maintaining it in a horizontal attitude. Then the ball 7 is hit in a manner that rotates the swivel-arm sleeve 27 and positions the swivel rod 40 in an attitude that, together with amount of rotation of the swivel-arm sleeve 27, indicates flight trajectory of an actual ball so hit by a trainee. Different attitudes of the swivel rod 40 are shown in dashed lines. The pillar base 3 can be a plurality of tubular members extended radially from the swivel-arm pillar 2.

A height-adjustment means is height-adjustment pin 44 that is positioned in the pillar-height orifices 28 to hold the swivel-arm pillar 2 at desired heights where there are pillar-height orifices 28. A thrust ring 45 is provided between a bottom end of the swivel-arm sleeve 27 and the height-adjustment pin 44.

To allow the swivel-arm sleeve 27 to pivot freely on the swivel-arm pillar 2, a plurality of friction-reduction bearings 46 on bearing axles 47 is attached to a top portion of the swivel-arm pillar 2 in bearing contact with an inside periphery of the swivel-arm sleeve 27. Additionally, a plurality of the friction-reduction bearings 46 can be attached to a bottom portion of the swivel-arm sleeve 27 with the bearing axles 47 in a horizontal attitude for weight-bearing relationship between the bottom of the swivel-arm sleeve 27 and the thrust ring 45 which is employed as a height-adjustment means. Further in addition, a plurality of the friction-reduction bearings 46 is attached to a bottom portion of the swivel-arm sleeve 27 with the bearing axles 47 in a vertical attitude to position outside surfaces of the friction-reduction bearings 46 in contact with a bottom portion of the outside periphery of swivel-arm pillar 2 for further reducing rotational friction of the swivel-arm sleeve 27 on the swivel-arm pillar 2.

Referring to FIG. 11, a bearing means for minimizing rotational friction can be at least one friction-reduction bearing 48, such as a ball bearing, positioned on a top portion of the swivel-arm pillar 2 in friction-reduction relationship between the swivel-arm pillar 2 and the swivel-arm sleeve 27. A bearing means for minimizing rotational friction from both weight and side pressure can be a dual-purpose bearing 49, such as a cone bearing, positioned between a flange bottom of the swivel-arm sleeve 27 and the swivel-arm pillar 2 as shown. A bottom of the dual-purpose bearing 49 is supported by the height-adjustment pin 44.

Referring to FIG. 12, the height-adjustment means is a collar 50 with collar orifices 51 positional concentrically with the pillar-height orifices 28 for inserting the height-adjustment pin 44 through both the collar 50 and the swivel-arm pillar 2. Contacting surfaces of the collar 50 and the swivel-arm sleeve 27 can be coated, surfaced, taped or otherwise provided with friction-reduction material 52 on or between them. Friction-reduction material 52 can be positioned also in friction-reduction relationship between a top portion of the swivel-arm pillar 2 and the inside periphery of the swivel-arm sleeve 27.

The present invention can be used as a practice and training device for hitting baseballs, tennis balls or event racket ball and handball. Also, merely by varying the angle of the swivel arm so that the object is near the ground, the device can be used to practice hitting a golf ball, a hockey puck or even to kick a soccer ball. Furthermore, the present apparatus could be electronically connected to a computer to play an interactive video game where the user actually hits the ball or other object.

A new and useful object hitting apparatus having been described, all such modifications, adaptations, substitutions of equivalents, combinations of parts, applications and forms thereof as described by the following claims are included in this invention.

I claim:

1. A batting practice apparatus, comprising:

a base member supporting the apparatus on a surface;

a vertical support post extending from the base member;

a sleeve coaxially rotatably mounted on the vertical support post;

an elongated suspension pivotally attached at one end thereof adjacent the top end of the sleeve by a pivot axis perpendicular to the sleeve;

an arm member having first and second ends attached to the other end of said of the suspension bracket and being substantially perpendicular to said pivot axis; and an object attached to one end of said arm member.

2. The apparatus of claim 1 further comprising friction reducing means between the vertical support post and the sleeve.

3. The apparatus of claim 1 further comprising a height-adjustment means said sleeve and the vertical support post.

4. The apparatus of claim 3 wherein said support post is provided with a plurality of vertically spaced, horizontal apertures extending diametrically therethrough, and said sleeve is provided with at least one aperture extending horizontally therethrough, whereby means defining a retaining pin is inserted through aligned apertures in said post and sleeve to thereby retain said arm member at an adjusted height above to said base.

5. The apparatus of claim 1 further comprising a counter balance weight attached to said second end of said at an opposite which the object is attached.

* * * * *